US008667692B2

(12) United States Patent
Kraus

(10) Patent No.: US 8,667,692 B2
(45) Date of Patent: Mar. 11, 2014

(54) ELECTRIC HAIR REMOVAL APPARATUS

(75) Inventor: Bernhard Kraus, Braunfels (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 12/052,132

(22) Filed: Mar. 20, 2008

(65) Prior Publication Data

US 2008/0196258 A1 Aug. 21, 2008

Related U.S. Application Data

(63) Continuation of application No. PCT/EP2006/007921, filed on Aug. 10, 2006.

(51) Int. Cl.
*B26B 21/40* (2006.01)
*B26B 19/02* (2006.01)

(52) U.S. Cl.
USPC ..... 30/43.92; 30/43.1; 606/133

(58) Field of Classification Search
USPC ..... 30/43.5–43.92, 43.1, 43.3, 41.7, 41.8, 30/DIG. 1, 934.2, 35–39; 362/115; 388/809, 815; 318/119, 128; 322/26; 606/133, 9
See application file for complete search history.

(56) References Cited

U.S. PATENT DOCUMENTS

| | | | | |
|---|---|---|---|---|
| 4,139,940 | A * | 2/1979 | Buras et al. | 30/43.92 |
| 4,594,777 | A * | 6/1986 | Kimoto et al. | 30/42 |
| 4,719,698 | A * | 1/1988 | Ninomiya et al. | 30/43.6 |
| 5,014,428 | A * | 5/1991 | Yamashita | 30/43.6 |
| 5,274,735 | A * | 12/1993 | Okada | 388/815 |
| 5,367,599 | A | 11/1994 | Okada | |
| 5,600,888 | A * | 2/1997 | Becker | 30/41.7 |
| 5,617,503 | A * | 4/1997 | Fronen et al. | 388/815 |
| 5,632,087 | A * | 5/1997 | Motohashi et al. | 30/43.92 |
| 5,920,988 | A * | 7/1999 | Momose | 30/41 |
| 6,233,535 | B1 * | 5/2001 | Petretty | 702/187 |
| 6,634,104 | B2 | 10/2003 | Jacobsen | |
| 6,708,408 | B2 * | 3/2004 | Orloff | 30/41.7 |
| 6,871,402 | B2 * | 3/2005 | Bader et al. | 30/43.92 |
| 7,282,060 | B2 * | 10/2007 | DeBenedictis et al. | 607/88 |
| 7,479,137 | B2 * | 1/2009 | Yamazaki et al. | 606/9 |
| 7,824,395 | B2 * | 11/2010 | Chan et al. | 606/10 |
| 2001/0025421 | A1 | 10/2001 | Damstra | |
| 2003/0234352 | A1 * | 12/2003 | Chee | 250/231.13 |
| 2005/0127058 | A1 | 6/2005 | Shalev et al. | |
| 2005/0154380 | A1 * | 7/2005 | DeBenedictis et al. | 606/9 |
| 2005/0177139 | A1 * | 8/2005 | Yamazaki et al. | 606/9 |
| 2009/0000126 | A1 * | 1/2009 | Kraus | 30/34.1 |

FOREIGN PATENT DOCUMENTS

| | | |
|---|---|---|
| DE | 42 01 027 | 7/1992 |
| DE | 690 20 388 | 11/1995 |
| DE | 100 52 127 | 5/2002 |
| EP | 0 719 202 | 8/1998 |
| FR | 2 749 793 | 12/1997 |

(Continued)

*Primary Examiner* — Laura M Lee
(74) *Attorney, Agent, or Firm* — Jerry J Yetter; Jason J Camp; Kelly L McDow

(57) ABSTRACT

An electric hair removal apparatus for removing hair from the human skin. The hair removal apparatus includes a housing adapted to be held in the hand, a mechanically working hair removal device and a motor for driving the hair removal device. Provision is made for a sensor device for generating a signal that depends on the speed at which the hair removal device is moved over the skin during the hair removal.

1 Claim, 3 Drawing Sheets

(56) References Cited

FOREIGN PATENT DOCUMENTS

| | | | | |
|---|---|---|---|---|
| JP | 408117458 | * | 5/1996 | ..... B26B 19/38 |
| JP | 2004-141327 | A | | 5/2004 |
| WO | WO 03/101243 | | * | 11/2003 |
| WO | WO2004/080232 | | | 9/2004 |

* cited by examiner

ELECTRIC HAIR REMOVAL APPARATUS

RELATED APPLICATIONS

This application is a continuation of, and claims priority under 35 U.S.C. 120 from, International Application No. PCT/EP2006/007921, filed Aug. 10, 2006, which claimed priority under 35 U.S.C. 119(a) from German Patent Application DE 10 2005 045713.4, filed Sep. 24, 2005. Both priority applications are incorporated herein in their entirety.

TECHNICAL FIELD

This invention relates to an electric hair removal apparatus, and more particularly to a method for removing hair from the human skin.

BACKGROUND

Electric hair removal apparatuses are frequently operated by means of integrated batteries, in particular rechargeable batteries. In this way it is possible to prevent the handling of the hair removal apparatuses being obstructed by cords. Because the storage capacity of the batteries is limited, it is desirable to make the most efficient possible use of the stored electric power. A large part of the electric power consumed on operating the hair removal apparatuses is not used directly for removing the hairs but is wasted, for example, through friction in the drive train of the hair removal apparatuses. This means that there is a considerable consumption of electric power during the operation of hair removal apparatuses even when no or only few hairs are being removed.

To keep the power consumption in limits and still achieve an adequate removal of hair, hair removal apparatuses are often designed for anticipated average operating conditions. This results however in the hair removal apparatuses causing vibrations and noises under no-load conditions, i.e., when no hairs are being removed, and displaying an inadequate function under full-load conditions, i.e., when very many hairs are being removed. This undesirable behavior can be counteracted by controlling the rotational frequency of the drive motor of the hair removal apparatus.

For example, from DE 42 01 027 A1 and U.S. Pat. No. 5,367,599 there is known an electric shaver that deduces whether a beard is thick or thin dependent on the load current of the motor. The motor is then controlled on the basis of the determined beard thickness. With a thin beard the motor is operated at a low rotational speed; with a thick beard it is operated at a high speed.

From EP 0 719 202 B 1 there is known a shaving apparatus with an electric motor whose speed is varied by a forward-coupled closed-loop control unit as a function of at least one physical variable. The physical variable is measurable by means of a detecting element that detects an audio signal for determining the hairs cut per unit of time, the elapsed shaving time, or a skin contact force.

SUMMARY

In one aspect, an electric hair removal apparatus for removing hair from the human skin features a housing adapted to be held in the hand, a mechanically working hair removal device and a motor for driving the hair removal device. Provision is made for a sensor device for generating a signal that depends on the speed at which the hair removal device is moved over the skin during the hair removal.

One advantage of the hair removal apparatus described herein is that by using the signal of the sensor device it is possible to achieve a low level of power consumption while still enabling a removal of hair which is thorough and gentle on the skin. In case of battery operation, there results a longer battery life compared to known hair removal apparatuses or batteries with reduced dimensions. In addition, during fast movements of the hair removal device relative to the skin there is no painful pulling of the hairs. Another advantage is that the level of noise and the vibrations during operation of the hair removal apparatus can be kept relatively low on the whole.

The sensor device may have at least one rotatably mounted rotary element. The rotary element is arranged preferably such that it is set in rotation when the hair removal device is moved over the skin. In addition, the sensor device may have a detecting element for the direct or indirect detection of the rotation of the rotary element. In this way it is possible with simple means to detect the speed of the hair removal device relative to the skin.

It is also possible for the sensor device to include a light source and a light sensor. The light source is arranged preferably such that it shines on the skin when the hair removal device is moved over the skin. Having no moving parts, this embodiment of the sensor device has a long service life. Furthermore, a sensor device thus constructed works very reliably and accurately.

In a preferred embodiment, the hair removal apparatus has a control device for controlling the motor in dependence upon the signal of the sensor device. In this embodiment provision may be made for the control device to control, in closed-loop or open-loop mode, a movement variable of a component of the hair removal device to a first predeterminable value which is responsive to the signal of the sensor device. This means that the movement of the component is a function of the speed at which the hair removal device is moved over the skin. The movement variable may be in particular a speed or an oscillation amplitude of the component of the hair removal device.

It is also possible for the control device to control, in closed-loop or open-loop mode, a movement variable of the motor to a second predeterminable value which is responsive to the signal of the sensor device. In this embodiment it is an advantage for provision to be made for a motor sensor to provide a signal for the control device, which signal is responsive to the movement variable of the motor. The movement variable may be a rotational frequency, a speed or an oscillation amplitude of the motor. It is particularly advantageous for the control device to determine the second predeterminable value on the basis of the first predeterminable value.

In some implementations, the hair removal apparatus may be developed further such that the control device controls the motor in dependence upon a user setting for skin sensitivity and/or a power consumption of the motor and/or a current hair removal mode and/or a variable determined in the past and/or progress made in the hair removal and/or a minimum and/or maximum value for the movement variable of the motor or the component of the hair removal device. It is thereby possible for the hair removal apparatus to be optimized still further and be specially adapted to the respective user.

Preferably, the hair removal apparatus is constructed as a shaving apparatus. Construction as an epilator is also possible however.

With the method for removing hairs from the human skin as described herein, an electric hair removal apparatus that includes a motor-driven hair removal device is passed over the skin. The method is characterized by the step of controlling the motor in dependence upon the speed at which the hair removal apparatus is moved over the skin.

In some embodiments, it is possible to control a movement variable of a component of the hair removal device, in closed-loop or open-loop mode, to a first predeterminable value which depends on the speed at which the hair removal apparatus is moved over the skin. In addition, a movement variable of the motor can be controlled, in closed-loop or open-loop mode, to a second predeterminable value which depends on the speed at which the hair removal apparatus is moved over the skin.

Various implementations will be explained in more detail in the following with reference to the embodiments illustrated in the accompanying drawings.

DETAILED DESCRIPTION

Figure 1:
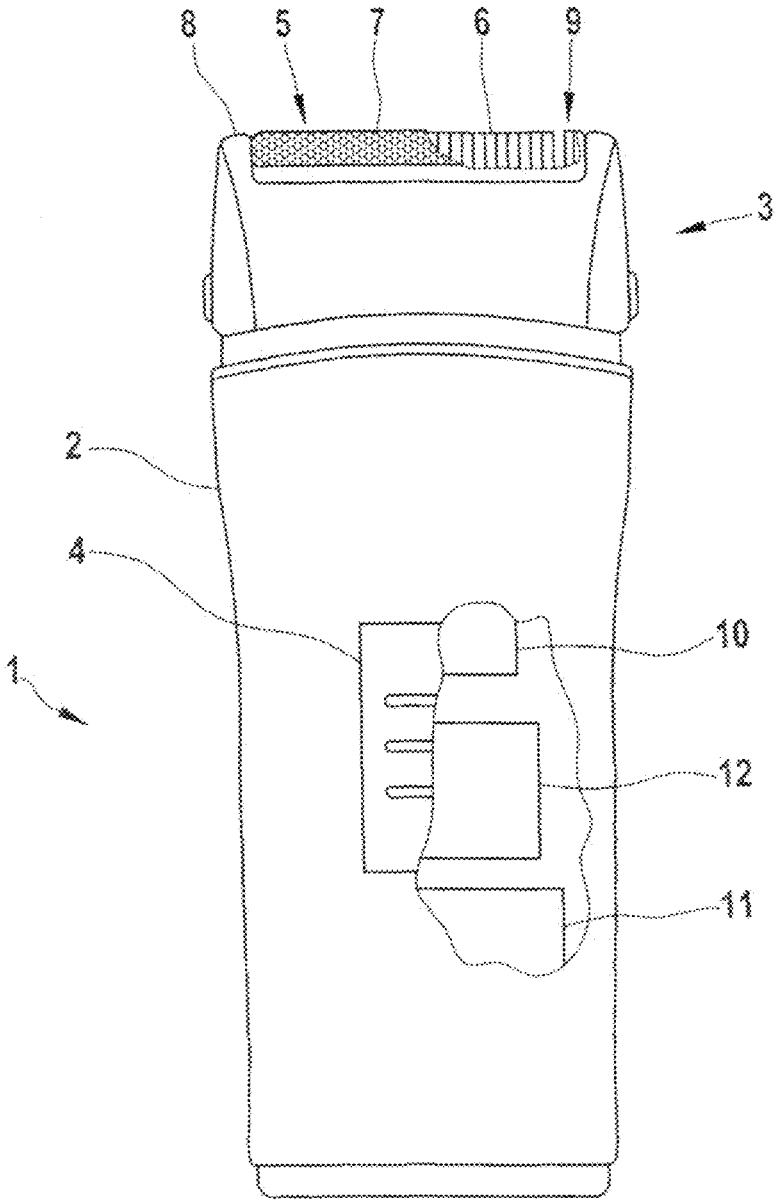
FIG. 1 is a side view of an embodiment of an electric shaving apparatus.

FIG. 1 shows, in a side view, an embodiment of an electric shaving apparatus 1. The shaving apparatus 1 includes a housing 2 adapted to be held in the hand and a shaving head 3 attached thereto. Arranged on the housing 2 is a switch 4 for switching the shaving apparatus 1 on and off.

The shaving head 3 includes a shaving system 5 with an undercutter 6 and a shaving foil 7. The shaving foil 7 is mounted in a holding frame 8. In addition, the shaving head 3 includes a sensor device 9 for detecting the speed at which the shaving head 3 is moved during the shave over the skin. The construction and mode of operation of the sensor device 9 will explained in more detail with reference to FIGS. 2 and 3.

Arranged in the interior of the housing 2 are further components of which some are represented schematically in FIG. 1. One of these components is a motor 10 that drives the undercutter 6. The motor 10 may be constructed as a rotary motor and be coupled via an eccentric device, not represented in the drawing, to the undercutter 6. Similarly, it is also possible to construct the motor 10 as a linear motor. A rechargeable battery 11 and a microcontroller 12 are symbolically represented as further components. The battery 11 delivers the supply voltage for operating the shaving apparatus 1, with the motor 10 being the biggest power consumer. The microcontroller 12 is needed in particular for evaluating the signals of the sensor device 9 and controlling the motor 10 as described in more detail in the following.

During operation of the shaving apparatus 1, the undercutter 6 is set in a linear oscillating motion relative to the shaving foil 7. This movement results in hairs which penetrate the shaving foil 7 up to the undercutter 8 being caught by the undercutter 8 and severed in interaction with the shaving foil 7.

Figure 2:
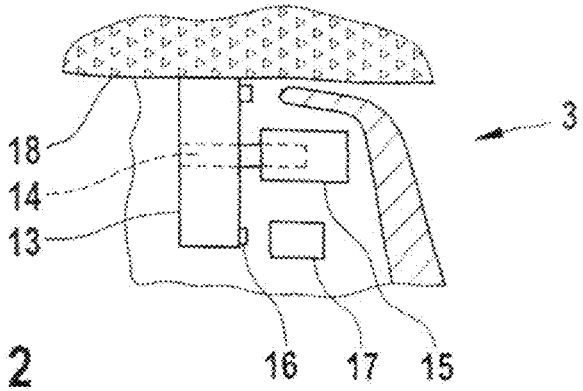
FIG. 2 is an enlarged sectional view of a detail of the shaving apparatus to illustrate an embodiment of the sensor device.

FIG. 2 shows, in a sectional representation, an enlarged detail of the shaving apparatus 1 in order to illustrate an embodiment of the sensor device 9. In the embodiment shown, the sensor device 9 has a transmitter wheel 13 with an axle 14 which is rotatably mounted in a sleeve 15. The transmitter wheel 13 has several markings 16 which are arranged at regular intervals side by side in the circumferential direction of the transmitter wheel 13. A detecting element 17 is fitted adjacent to the transmitter wheel 13 in the region of the radius in which the markings 16 are arranged on the transmitter wheel 13. The detecting element 17 responds to the markings 16 and, upon rotation of the transmitter wheel 13, generates a signal at those regular intervals at which the markings 16 are moved past the detecting element 17.

The detection of the markings 16 may be effected in different ways, for example by visual means, by induction, etc. Also, the mechanical construction of the sensor device 9 may be modified in a wide variety of ways. For example, the transmitter wheel 13 may be driven by another wheel, not shown in the drawing, or by a ball. In addition, several differently oriented transmitter wheels 13 with associated detecting elements 17 may be provided to detect different directions of movement of the shaving head 3.

Represented in FIG. 2 is in addition a skin surface 18 over which the shaving head 3 of the shaving apparatus 1 is moved, i.e., FIG. 2 shows a snap-shot during the performance of a shave using the shaving apparatus 1. During the shave, the shaving head 3 is pressed with slight pressure against the skin surface 18 and at the same time moved laterally relative to the skin surface 18. Apart from the shaving foil 7, the transmitter wheel 13 is in this case also in touching contact with the skin surface 18 and converts the translational movement of the shaving head 3 into a rotational movement which the detecting element 17 detects and converts into a corresponding signal. Given a fast translational movement of the shaving head 3 relative to the skin surface 18, the transmitter wheel 13 is set in a fast rotational movement so that the detecting element 17 generates a signal with a relatively high frequency and makes it available at its output. By contrast, given a slow translational movement of the shaving head 3, a slow rotation of the transmitter wheel 13 is produced so that the signal issued by the detecting element 17 has a relatively low frequency. The frequency of the signal generated by the detecting element 17 is thus a measure of the speed at which the shaving head 3 of the shaving apparatus 1 is moved over the skin surface 18. This speed may also be determined with the embodiment of the sensor device 9 represented in FIG. 3.

Figure 3:
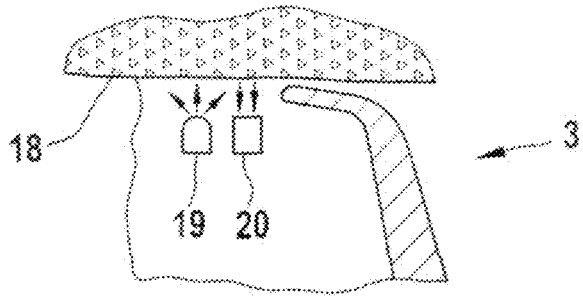
FIG. 3 is a view of another embodiment of the sensor device in a representation corresponding to FIG. 2.

FIG. 3 shows another embodiment of the sensor device 9 in a representation corresponding to FIG. 2. In this embodiment the sensor device 9 includes a light source 19 and a light sensor 20. The light source 19 could be, for example, a light-emitting diode. A photodiode is suitable as a light sensor 20. The light source 19 is mounted in the shaving head 3 such that it emits light in the direction of the skin surface 18 when the shaving head 3 is moved during a shave over the skin surface 18. Part of the light is reflected on the skin surface 18, whereby part of the reflected light is detected in turn by the light sensor 20. According to the light detected, the light sensor 20 generates an electric signal which is a measure of the speed at which the shaving head 3 is moved over the skin surface 18. The evaluation of the signal emitted by the light sensor 20 may be performed in similar manner to that used for an optical computer mouse.

The further processing of the signals generated with the embodiments of FIG. 2 and FIG. 3 will be explained in more detail with reference to FIG. 4.

Figure 4:
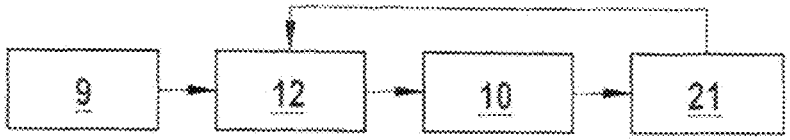
FIG. 4 is a block diagram illustrating a possible variant of a control arrangement for the motor of the shaving apparatus.

FIG. 4 shows a block diagram of a possible variant of a control arrangement for the motor 10 of the shaving apparatus 1. The diagram relates to an embodiment of the shaving apparatus 1 in which the motor 10 is constructed as a rotary motor. The blocks shown represent the sensor device 9, the microcontroller 12, the motor 10, and an rpm sensor 21 which detects the current rotational frequency of the motor.

The signal issued by the sensor device 9 is fed to the microcontroller 12. The microcontroller 12 determines, on the basis of this signal, a set-point value for the speed of the undercutter 6 relative to the shaving foil 7. The set-point value may be calculated, for example, with the aid of an algorithm implemented in the microcontroller 12 or be read out from a table stored in the microcontroller 12. This involves selecting the set-point value such that favorable cutting conditions for severing the hairs result for the speeds of the shaving head 3 relative to the skin surface 18 determined by the sensor device 9. During the cutting operation the hairs are temporarily gripped between the undercutter 6 and the shaving foil 7 directly before they are severed. Through the movement of the shaving head 3 relative to the skin surface 18, the gripped hairs are pulled slightly out of the skin before they are severed by interaction of the undercutter and the shaving foil. This effect is desired and results during the subsequent second cut in the hairs being severed closer to their roots, thus enabling a very thorough shave.

However, the hairs must not be pulled too far out of the skin because this would be painful for the user of the shaving apparatus 1. The pain threshold lies typically at a value of 0.4 mm, approximately, i.e., if the hairs are pulled out of the skin by more than 0.4 mm, this is usually perceived as painful. Conversely, if the hairs are pulled too little out of the skin, then the shave is not particularly thorough. This means that if the shaving head 3 is passed at high speed over the skin surface 18, then the hairs should be severed relatively quickly after they are gripped. On the other hand, if the shaving head 3 is passed slowly over the skin surface 18, then a longer period of time should be allowed to elapse between the gripping and the severing of the hairs. In some embodiments, the faster the shaving head 3 is moved over the skin surface 18, the higher the set-point value is selected for the speed of the undercutter 6.

From the set-point value for the speed of the undercutter 6, the microcontroller 12 determines a set-point value for the rotational frequency of the motor 10. The set-point value is selected such that the speed of the undercutter 6 concurs with the set-point value when the motor 10 rotates with the set-point value for the rotational frequency. Like the set-point value for the speed of the undercutter 6, the set-point value for the motor rotational frequency can also be calculated by means of an algorithm or be read out from a table. The thus determined set-point value of the motor rotational frequency is compared with the actual value detected by the rpm sensor 21. On the basis of this set-point/actual value comparison, the microcontroller 12 controls the motor 10 such that the actual value approximates to the set-point value. In this case account can be taken of the inertia of the motor 10 and the motor 10 can be controlled accordingly in closed-loop mode to a somewhat higher rotational frequency than that corresponding to the set-point value.

When determining the set-point value for the speed of the undercutter 6, account may be given to one or more variables in addition to the signal of the sensor device 9. For example, provision may be made for the user to be able to make a setting on the shaving apparatus 1 with regard to the sensitivity of his skin. This setting is then evaluated in connection with determining the set-point value. Similarly, it is possible to take account of the thickness of the user's beard. The thickness of the beard can be estimated from the current consumption of the motor 10. In addition, account may be given to the respective shaving mode in which the shaving apparatus 1 is operated. For example, provision may be made for a constant set-point value when the long-hair cutter is swung out. Also, provision may be made for a memory function by means of which the microcontroller 12 can determine the user's behavior and adjust the set-point value thereto. For example, a comparatively high set-point value may be selected if the user usually shaves quickly or if the shaving apparatus 1 was not used for so long that a thicker beard is likely. When determining the set-point value account may also be taken of the shaving progress during a shave. For example, a different set-point value may be selected at the beginning of the shave than toward the end of the shave. In addition, when determining the set-point value it is possible to take account of a minimum value and a maximum value for the speed of the undercutter 6 which must not be undershot or overshot.

Furthermore it is also possible to take account of the fact that, when controlling the motor 10, too fast a control is perceived as disagreeable by the user, and to limit the speed of control correspondingly.

In an embodiment of the shaving apparatus 1 in which the motor 10 is constructed as a linear motor, it is possible in corresponding manner, as previously described for the rotational frequency of a rotary motor, for the motor speed or oscillation amplitude of the motor 10 to be controlled in closed-loop mode.

In addition, the shaving apparatus 1 may also be constructed such that a movement variable of the undercutter 6, for example its speed or oscillation amplitude, is directly detected and controlled in closed-loop mode. Also possible is a modification of the shaving apparatus 1 on which a pure open-loop control without actual value detection is performed instead of a closed-loop control.

Figure 5:
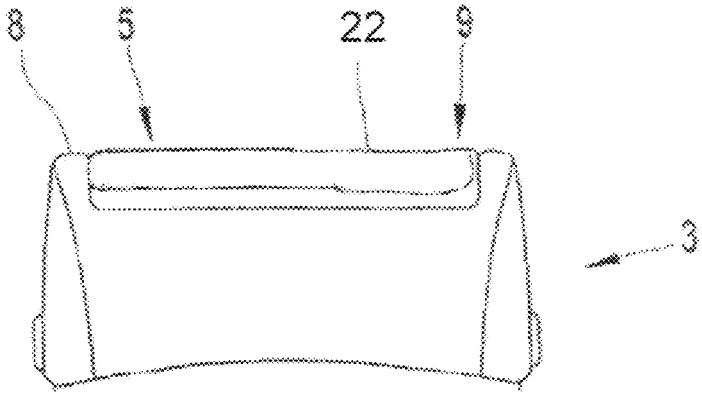
FIG. 5 is a side view of an embodiment of an electric shaving apparatus with rotating tweezers.

It will be appreciated that application of the sensor described herein is not restricted to an application on shaving apparatuses 1 but may also be used on other electric hair removal apparatuses which have a mechanically working hair removal device. Apart from shaving apparatuses 1, said hair removal apparatuses may include in particular epilators which, with the help of rotating tweezers 22 shown schematically in FIG. 5, grip hairs and pluck them out of the human skin. On epilators the rotation velocity of the tweezers or the opening and/or closing speed of the tweezers may be varied in dependence upon the speed at which the epilator is moved over the skin.

What is claimed is:

1. An electric hair removal apparatus to shave hair, comprising:

a housing;

a hair removal device coupled to the housing comprising a shaving head which comprises an undercutter and a foil;

a drive motor operable to drive the undercutter of the hair removal device; and a controller that regulates the operational speed of the drive motor based on a setting selected by a user and by a light sensor that generates a signal to the controller that regulates the operational speed of the hair removal device's drive motor to a predetermined value based on the speed at which the hair removal device is moved over the skin, wherein the light sensor comprises a light source, in which the light source is arranged to illuminate the skin while the hair removal device is moved over the skin, wherein said selected setting causes the hair to be cut by the undercutter before said hair is pulled out of the skin by the foil by a distance greater than about 0.4 mm due to the speed the hair removal device is moved over the skin.

* * * * *